United States Patent [19]

Cooper et al.

[11] 3,936,821

[45] Feb. 3, 1976

[54] SUPERVISORY CIRCUIT FOR PARALLEL CONNECTED DEVICES

[75] Inventors: Glenn F. Cooper, West Springfield; Daniel J. Marceau, Springfield, both of Mass.

[73] Assignee: Standard Electric Time Corporation, Springfield, Mass.

[22] Filed: May 15, 1974

[21] Appl. No.: 470,063

[52] U.S. Cl. ..... 340/409; 340/213.1

[51] Int. Cl.[2] ..... G08B 23/00

[58] Field of Search ..... 340/213.1, 409, 233, 285

[56] References Cited

UNITED STATES PATENTS

| | | | |
|---|---|---|---|
| 3,389,390 | 6/1968 | Waller | 340/285 X |
| 3,544,984 | 12/1970 | Hanson | 340/233 X |

*Primary Examiner*—Harold I. Pitts

*Attorney, Agent, or Firm*—Johnson, Dienner, Emrich & Wagner

[57] ABSTRACT

A supervisory circuit for a plurality of continuously-conductive alarm devices connected in parallel between a pair of conductors monitors the operability of the circuit as well as the operability of each of the devices. Alarm devices having a low impedance are connected between the conductors over a parallel-connected resistor and diode which unidirectionally increases the impedance of such devices. The alarm circuit is connected in one arm of a balanced bridge circuit which has a detecting circuit connected in a further branch of the bridge circuit for monitoring the impedance of the circuit and for providing a supervision signal in response to a change in the impedance of the alarm circuit indicating inoperability of a device or open or short circuit conditions for the conductors which connect the devices into the circuit.

13 Claims, 2 Drawing Figures

SUPERVISORY CIRCUIT FOR PARALLEL CONNECTED DEVICES

BACKGROUND OF THE INVENTION

1. Field of the Invention

This invention relates to supervisory circuits, and more particularly to a circuit for supervising an alarm circuit having a plurality of parallel-connected, continuously-conductive alarm devices.

2. Description of the Prior Art

Increasing functional demands increase the complexity of many modern circuits. Even long-known circuits are today more complex than at the time of their invention. Such increased complexity may result both from increasing the size of the circuit to provide more, similar functions and from decreasing the size of the circuit to provide the same function in a smaller space. An alarm circuit extending throughout today's larger buildings exemplifies the former type of increased complexity, while an integrated circuit exemplifies the latter.

This increase complexity makes difficult or impossible the manual supervision of the proper functioning of individual devices in the circuit. For example, an alarm circuit having but few alarm indicating devices cound be supervised by periodically activating the alarm and manually checking the operability of each alarm device. However, when a large number of such alarm devices are employed, manual supervision becomes impractical. Similarly, when discrete circuits are employed, it is practical to tap and test individual circuit devices of the circuit, but when integrated circuits are used, it is difficult to tap and test portions of the integrated circuit.

Therefore, automatic supervision of circuit operability is desirable. Many circuit supervisory systems have been developed, but have not been entirely successful, especially when used with circuits having a plurality of parallel-connected, continuously conductive devices. If the impedance of the individual devices is low, the collective impedance across a circuit of such devices is considerably low. In some cases, the impedance across the circuit may be comparable with the impedance of conductors which connect the devices in parallel so that a discontinuity in one of the devices is difficult to detect. Furthermore, the low impedance of the circuit may be within the range of expected impedance variations inherent in the devices themselves. For example, the impedance across some devices varies more than ten percent with a 30°C. change in the temperature of the device. Similarly, corrosion or vibration of contacts of the device may vary the rest impedance of the contacts sufficiently to affect the impedance across a parallel circuit of such devices.

Alarm circuits exemplify these problems for a system supervising the continued operability of individual alarm devices in the circuit. Alarm circuits generally have a plurality of continuously-conductive, parallel-connected alarm devices such as bells, horns, lights or the like. Typically, thirty or more alarm devices may be connected in a given alarm circuit. Since the alarm circuit is operated only during an alarm condition, it is desirable to provide continual supervision of the operability of each alarm device in the circuit.

One known supervision system for an alarm circuit has an end of line resistance connected between conductors across which the alarm devices are parallel-connected. Diodes in series with each alarm device effectively open circuit the devices to a potential of one polarity applied to the conductors, rendering the alarm devices non-conductive and inoperable by the potential while permitting a potential of the opposite polarity to operate the alarm devices. the end-of-line resistance permits monitoring of the one potential to indicate the continuity of the conductors. Although conductor continuity indicates operability of the conductors in the alarm circuit, the operability of individual alarm devices in the circuit is not monitored by systems of this type.

As is reported in the literature, attempts have been made to employ operational amplifiers connected in a bridge circuit with the alarm circuit to supervise individual alarm devices in an alarm circuit. In such cases, it was found that the range of operating temperatures to which the alarm circuit was exposed resulted in unstable operational amplifier conditions. Furthermore, the low collective impedance of parallel connected alarm devices comprising the alarm circuit necessitated a bridge circuit so sensitive as to be uneconomically expensive or, if less expensive, unreliable.

SUMMARY OF THE INVENTION

It is an object of the invention to provide an improved supervisory circuit for supervising the continued operability of individual, parallel-connected, continuously-conductive devices.

In accordance with the invention, the supervisory circuit comprises a bridge circuit having a plurality of parallel-connected, continuously-conductive devices connected between a pair of conductors in a first branch of the bridge circuit. The conductors supply energizing potential for the devices. Each of the parallel-connected devices has an impedance means connected in series therewith which provides a low impedance path to permit energization of the devices when a potential of a first polarity is applied to the conductors and to provide a high impedance path to permit monitoring of the continuity of the circuit path and the energizing conductors without energizing the devices when a potential of the opposite polarity is applied to the conductors.

A detecting means is connected in a cross-over branch of the bridge circuit. A suitable balancing means connected in a further branch of the bridge circuit balances the bridge circuit. In the event of an unbalance condition for the bridge circuit as may be caused by open or short circuit conditions of any one of the devices or associated impedance means or the conductors which connect the devices into the bridge circuit, the detector means is operable to provide an indication of such unbalance condition.

The detector means includes first and second switching means which are enabled in response to an increase or a decrease, respectively in the impedance of the bridge circuit to control an indicating means. An operational amplifier means may be employed to detect impedance changes in the bridge circuit and to provide an output for controlling the first and second switching means.

In accordance with an exemplary embodiment, the conductive devices comprise alarm providing devices of an alarm circuit, the alarm circuit being connected in the first branch of the bridge circuit. An alarm switching means normally applies a first potential to the conductors to enable monitoring of the impedance of each of the alarm devices as well as the conductors while maintaining the alarm devices unoperated. In the event of an alarm condition, the alarm switching means disconnects the alarm circuit from the bridge circuit and reverses the polarity of the potential applied to the conductors to enable operation of the alarm indicating devices.

DESCRIPTION OF THE DRAWING

A preferred embodiment which is intended to illustrate and not to limit the invention will now be described with reference to the drawing in which.

DESCRIPTION OF A PREFERRED EMBODIMENT

Figure 1:
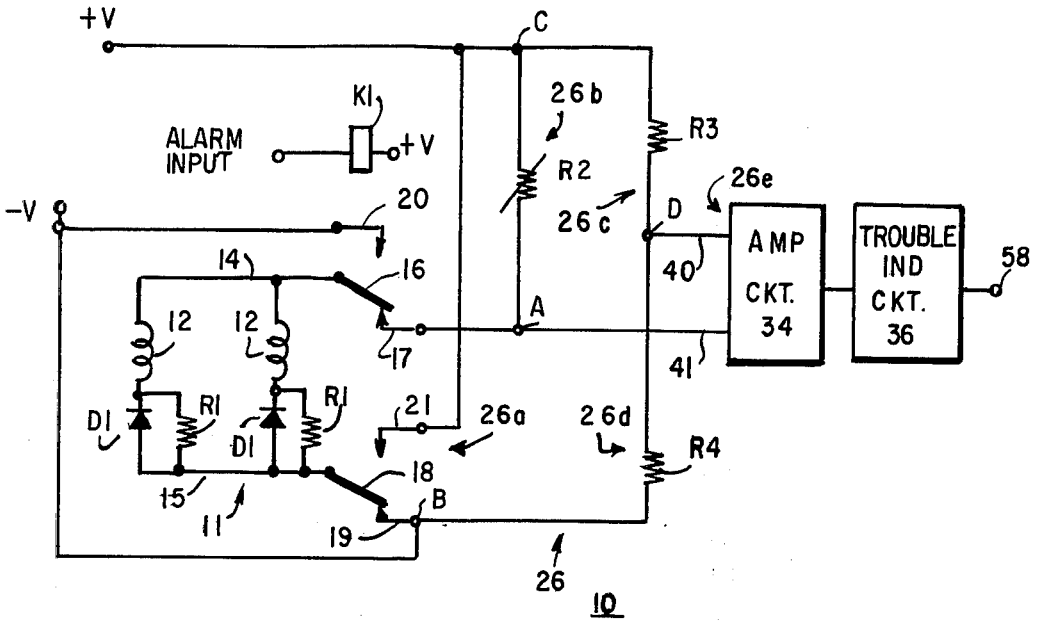
FIG. 1 is a schematic circuit and partial block diagram of a supervisory circuit provided by the present invention; and, FIG. 2 is a schematic circuit diagram of a portion of the supervisory circuit shown in FIG. 1.

Referring to FIG. 1, there is shown a schematic circuit diagram of a supervisory circuit 10 used to supervise the operability of a plurality of continuously-conductive devices 12. The devices 12, for example, may be driving coils for operating alarm devices such as horns or bells (not shown) associated with each device 12. The devices 12 may be connected in an alarm circuit 11 via a pair of conductors 14 and 15 and an alarm relay K1. The alarm relay K1 is normally unoperated and is operated in response to an alarm condition to effect the connection of an energizing potential to conductors 14 and 15 to enable devices 12 to be energized. The illustration of the devices 12 as alarm devices is merely exemplary of the various structures and functions of such continuously-conductive devices, other structures and functions within the scope of the invention being known in the art.

The devices 12 are each connected in series with a parallel combination of the diode D1 and a resistor R1 between the conductors 14 and 15. Conductor 14 is connected to a movable contact 16 of relay K1 illustrated as being in contact with a fixed contact 17 of relay K1 when relay K1 is deenergized. Conductor 15 is connected to a further movable contact 18 of relay K1 and is shown in contact with a further fixed contact 19 of relay K1. Contact 17 is connected over a variable resistor R2 to a positive voltage source +V, and contact 19 is connected to a negative voltage source −V.

Relay K1 has further fixed contacts 20 and 21 associated with movable contacts 16 and 18 respectively. Contact 20 is connected to the negative voltage source −V and contact 21 is connected directly to the positive voltage source +V. Thus, the relay K1 is operable to reversably connect the devices 12 across a DC power supply to provide an alternative polarity potential to the devices 12 as a function of the operation of relay K1.

When relay K1 is unoperated as illustrated in FIG. 1, and with the indicated potential supply polarity, current flows through the devices 12 and through resistors R1 for supervising the operability of the alarm circuit 11 as is described more fully hereinafter. When relay K1 is operated, the potential across the circuit 11 is reversed and current flows through the diode D1 now shunting resistors R1 to enable the alarm devices 12 to operate. The forward potential drop across the diodes D1 is small permitting normal, efficient operation of the alarm devices 12.

The supervisory circuit 10 basically comprises a bridge circuit indicated generally at 26. When relay K1 is unoperated, the alarm circuit 11 is connected in one arm **26*a* of the bridge circuit 26 between points A and B over contacts 16–19. A further arm 26*b* of the bridge circuit 26 comprises a variable resistor R2 which is connected between points A and C. Further arms 26*c* and 26*d* of the bridge circuit 26 comprise resistors R3 and R4** which are connected between points C and D and B and D, respectively.

A cross-over arm **26*e* of the bridge circuit 26 includes a detector circuit 34** which is connected between points A and D.

The adjustable resistor R2 adjusts the cross-over current or bridge balance to a desired initial level.

With the relay K1 unoperated, current flows through the bridge arms **26*a* and 26*b*, including the alarm circuit 11 and variable resistor R2 and through the bridge arms 26*c* and 26*d* comprising resistors R3 and R4. The impedance of the bridge arm 26*a*, including the alarm circuit 11, is determined by the parallel combination of the devices 12 and resistor R1, the diodes D1 appearing as open circuits to this direction of current flow. Thus, once the bridge circuit 26 is balance through the proper adjustment of resistor R2, any increase or decrease in the cross-over arm currents resulting from an impedance change in the alarm circuit 11 is detectable by the detector circuit 34. Short or open circuit conditions in the circuit conductors 14 or 15 cause circuit inoperability while an open circuit condition in a given device 12 connected in the alarm circuit 11 causes inoperability of such device 12. Detecting the change in impedance in the arm 26*a* of the bridge circuit 26 including the alarm circuit 11 resulting from open or short circuit conditions then is indicative of the inoperability of the alarm circuit 11 or one or more of the devices 12 connected in the alarm circuit 11**.

Since the impedance of the alarm circuit 11 is effectively high, due to the inclusion of impedance increasing resistances R1, an operational amplifier may be employed in the detector circuit for detecting changes in impedance as indicated by changes in the cross-over current.

The current limiting function of resistors R1 and R2 also permits the supervision of several devices 12. Often thirty or more devices 12 may be employed in a given alarm system with small power consumption. Moreover, resistors R1 are of such value as to make the conductive increment added to each of the devices 12 to be substantially independent of impedance variations inherent in the devices 12, as well as independent of temperature and contact variations. In general, an impedance value for resistors R1 of 47*K* ohms is suitable for this purpose.

The adjustable resistor R2 additionally permits changes to the alarm circuit 11 without changing the detector circuit 34. For example, when it is desired to add additional devices 12 to the alarm circuit 11 or other series or parallel devices, the variable resistor R2 is adjusted after such devices are added to the circuit 11, to return the current in the cross-over arm **26*e* of the bridge circuit 26 to the desired initial level relative to the level at which the detector circuit 34 detects changes. Accordingly, all or part of the alarm circuit 11 may be changed while the supervisory circuit 10 need only be adjusted to accomodate this change. A standard supervisory circuit 10 may then be used with a variety of circuits of which the illustrated circuit 11** is merely an example.

Figure 2:
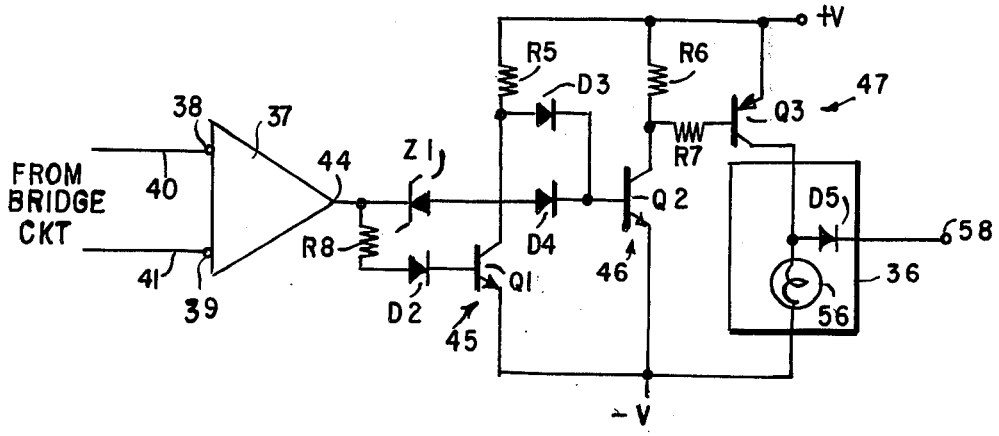

Referring to FIG. 2, there is shown a schematic circuit diagram of the detector circuit 34. The detector circuit 34 includes an operational amplifier 37 which monitors the potential difference between points D and A and provides an output signal for controlling a pair of switching stages 45 and 46, comprising normally conducting transistor Q1 and normally non-conducting transistor Q2. Transistor Q2 in turn controls a driver stage 47, including transistor Q3 which is operable when enabled by transistor Q2 to supply energizing current to a trouble indicator 36, embodied as a lamp 56.

Briefly, if an open-circuit condition occurs for either of the conductors 14 or 15, or one or more of the devices 12, the output signal provided by amplifier 37 causes transistor Q2 to turn on over a Zener diode Z1. If the conductors 14 or 15 become short-circuited, the output signal provided by the amplifier 37 causes transistor Q1 to turn off which in turn allows transistor Q2 to turn on through the combination of resistor R5 and diode D3.

In either of the above conditions, the turning on of transistor Q2 causes transistor Q3 to turn on energizing the trouble lamp 56.

As shown in FIG. 2, the operational amplifier 37 has inputs 38 and 39 connected to points D and A of the bridge circuit 26 over conductors 40 and 41, respectively. The output 44 of amplifier 37 is connected over a resistor R8 and a diode D2 to the base of transistor Q1 which comprises switching stage 45 of the detector circuit 34. The output 44 of amplifier 37 is also connected over a reverse connected Zener diode Z1 and a diode D4 to the base of transistor Q2 which comprises switching stage 46 of the detector circuit 34.

The collector of transistor Q1 is connected over a resistor R5 to the voltage source +V and the emitter of transistor Q1 is connected to the voltage source −V. Transistor Q1 is biased to be normally conducting whenever the output voltage provided by amplifier 37 is at a predetermined level, which in the exemplary embodiment is 8 volts.

The collector of transistor Q1 is connected over a diode D3 to the base of transistor Q2. Transistor Q2 has its collector connected over resistor R6 to the voltage source +V and its emitter connected to voltage source −V. Transistor Q2 is biased to be normally non-conducting when the output voltage provided by amplifier 37 is at the predetermined level.

The collector of transistor Q2 is connected over a resistor R7 to the base of transistor Q3 of the driver stage 47 of the detector circuit 34. The emitter of transistor Q3 is connected to voltage source +V and the collector of transistor Q3 is connected over the trouble indicator lamp 56 to the voltage source −V. Transistor Q3 is normally non-conducting, and accordingly, indicator lamp 56 is normally extinguished. In the event of a detection of an increase or decrease in the impedance of the bridge circuit by the operational amplifier 37, transistor Q2 is rendered conductive either by transistor Q1 or by the amplifier 37 over Zener diode Z1 causing transistor Q3 to be rendered conductive effecting energization of the indicator lamp 56. A diode D5 connected between the collector of transistor Q3 and an output terminal 58 of the indicator circuit 36 enables the output signal from transistor Q3 to be extended to a remote indicator (not shown). For example, the remote indicator may be a central trouble indicator of an alarm system.

OPERATION OF THE SUPERVISOR CIRCUIT

Referring to FIG. 1, under normal conditions, the alarm relay K1 is unoperated, and accordingly, supervisory current is enabled to flow through the branch **26*a* of the bridge circuit 26 which includes the alarm circuit 11. The monitoring current flows from point C over resistor R2 contacts 17 and 16 of relay K1 to conductor 14 and thence over the devices 12 and resistors R1 to conductor 15 and over contacts 18 and 19 to point B which is connected to voltage source −V. The resistors R2 and R1 are selected to have sufficiently large impedances to limit the current through the devices 12 to a level insufficient to operate the alarm devices 12**.

It is pointed out that in the event of an alarm condition, which causes alarm relay K1 to operate, movable contacts 16 and 18 engage contacts 20 and 21 applying a negative potential between conductors 14 and 15 permitting current to flow from conductor 15 over diode D1 and device 12 to conductor 14. The diode D1 then shunts the resistor R1 while relay K1 cuts out the resistor R2 such that substantially the entire input potential is applied to the devices 12, the forward impedance of diodes D1 being negligible. The resulting increased current through the devices 12 operates the associated alarm devices without interference from the supervisory circuit 10.

Assuming that relay K1 is unoperated and that resistor R2 has been adjusted to provide the desired value of cross-over current for the bridge circuit 26, then the operational amplifier 37 provides a predetermined output voltage, which is preselected to be 8 volts DC in the exemplary embodiment. Such potential is effective to cause transistor Q1 to be conductive while transistors Q2 and Q3 are non-conductive.

If either of the conductors 14 or 15 or one or more of the devices 12 becomes open-circuited, the impedance of the branch **26*a* of the bridge circuit 26 including the alarm circuit 11 increases causing an increase in the potential at point A while the potential at point B between fixed resistors R3 and R4 remains constant. The gain of the operational amplifier 37 is selected such that this change in the impedance produces an output potential sufficient to break down Zener diode Z1. The output potential from amplifier 37 is then extended over diode D4 to the base of transistor Q2 causing transistor Q2 to turn on. When transistor Q2 turns on, the collector of transistor Q2 approaches the potential −V causing transistor Q3 to turn on thereby energizing the indicator lamp 56 to indicate a trouble condition for the alarm circuit 11**.

Alternatively, if a short circuit condition should occur in the alarm circuit 11, the potential at A decreases to approximately the voltage −V. The output from the operational amplifier then decreases causing cutoff of diode D2 and transistor Q1. When transistor Q1 is turned off, the potential at the collector of transistor Q1 increases, causing diode D3 to become forward biased thereby rendering transistor Q2 conductive. As indicated above, when transistor Q2 becomes conductive, transistor Q3 in turn is rendered conductibe energizing the trouble indicator lamp 56.

Thus, the signal from transistor Q3 to indicator 56 indicates the inoperability of the alarm circuit 11, the object of the supervisory circuit 10. The signal from transistor Q3 occurs when the impedance of the alarm circuit 11 increases or decreases from that over which the initial bridge cross-over current is set. Such impedance changes in the circuit 11 result from opening of a device 12 in the circuit 11 or both the opening or shorting of the circuit conductors 14 and 15, making device 12 or circuit 11 inoperable.

The preferred utility of the embodiment in supervising an alarm system 11 is merely intended to illustrate the utility of the invention. It will be readily understood by those skilled in the art that the described supervision circuit 10 has utility with a variety of additional circuits.

We claim:

1. In a circuit having a plurality of functional devices at least some of which are connected in parallel between a pair of conductors for enabling energization of said functional devices, a supervisory circuit for supervising continued operability of each of said functional devices comprising a plurality of impedance means each individually connected in series with a different one of said functional devices between said conductors, each of said impedance means including a first circuit means connecting the corresponding functional device in a first circuit path between said conductors to provide an energizing path of a first impedance for enabling operation of the functional device and a second circuit means connecting the functional device in a second circuit path between said conductors to provide a supervisory path of a higher impedance indicative of the operability of the functional device for enabling supervision of the operability of the functional device, and means connected to said circuit and operable in the event of an impedance change in at least one of said supervisory paths to provide an output indicative of the inoperability of at least one of said functional devices.

2. In an alarm circuit having continuously conductive alarm operating devices at least some of which are connected in parallel between a pair of conductors for enabling energization of said alarm operating devices, a supervisory circuit for supervising continued operability of each of said alarm operating devices comprising a plurality of impedance means each individually connected in series with a different one of said devices between said conductors, each of said impedance means including a first circuit means connecting the corresponding operating device in a first circuit path between said conductors to provide an energizing path of a first impedance for enabling energization of the corresponding device and a second circuit means connecting the operating device in a second circuit path between said conductors to provide a supervisory path of a higher impedance for enabling supervision of the operability of the device, the plurality of impedance means and the corresponding devices normally providing a collective impedance of a predetermined value between said conductors, and detecting means for monitoring the impedance between said conductors and for providing an output indicative of the inoperability of at least one of said devices in response to a change in the impedance from said predetermined value.

3. A supervisory circuit for an alarm circuit as set forth in claim 2 wherein said first circuit means comprises a diode means and said second circuit means comprises a resistance means connected in parallel with said diode means, said diode means providing said first circuit path and said resistance means providing said second circuit path.

4. A supervisory circuit for an alarm circuit as set forth in claim 2 which includes control means operable in a first mode to enable a unidirectional current to flow over each of said second circuit paths to permit monitoring of the operability of the functional devices, said control means being operable in a second mode to enable a unidirectional current to flow over said first circuit path to permit energization of said devices.

5. A supervisory circuit for an alarm circuit as set forth in claim 3 wherein said supervisory circuit comprises a bridge circuit having a plurality of branches, said alarm circuit being connected in one of said branches, said detecting means being connected in another one of said branches and balancing means connected in a further branch of said bridge circuit for balancing the bridge circuit, said detecting means being enabled to provide an output whenever an unbalance condition occurs for said bridge circuit.

6. A supervisory circuit for an alarm circuit as set forth in claim 4 wherein said detecting means includes operational amplifier means connected over said control means to said conductors for detecting a potential difference between said conductors established by the unidirectional current flowing over said second circuit path said operational amplifier means normally providing a first output signal and said operational amplifier means providing a further output signal in response to a change in the potential between said conductors, and output means responsive to said further output signal to provide an indication of a trouble condition for said alarm circuit.

7. A supervisory circuit for an alarm circuit as set forth in claim 6 wherein said output means comprises indicator means, first switching means responsive to an increase in a signal provided by said operational amplifier means to enable said indicator means to provide a trouble indication, and second switching means responsive to a decrease in the signal provided by said operational amplifier means to enable said first switching means to thereby enable said indicator means.

8. In an alarm circuit having a plurality of continuously conductive functional devices connected in parallel between a pair of conductors for enabling energization of said functional devices, a supervisory circuit comprising a bridge circuit having a plurality of branches, said alarm circuit being connected in one of said branches, a plurality of impedance means each connected in series with a different one of said functional devices in said one branch between said conductors of said alarm circuit, each of said impedance means including a first circuit means connecting the corresponding functional device in a first circuit path between said conductors to provide an energizing path of a first impedance for enabling operation of the functional device and a second circuit means connecting the functional device in a second circuit path between said conductors to provide a supervisory path of a higher impedance for enabling supervision of the operability of the functional device, energizing means for normally providing current flow over said bridge circuit including the supervisory paths provided by each of said impedance means in said one branch, balancing means connected in a further branch of said bridge circuit for adjusting the balance of said bridge circuit to establish a potential difference of a preselected level indicative of the impedance of said one branch between first and second nodes of said bridge circuit, detecting means connected between said first and second nodes for providing an output signal proportional to the potential difference, said output signal increasing in the event of an open circuit condition in said alarm circuit and said output signal decreasing in the event of a short circuit condition in said alarm circuit, and output means for providing an output indicative of a change in impedance of said one branch in response to a change in the output signal provided by said detecting means.

9. A supervisory circuit as set forth in claim 8 wherein said first circuit means comprises a diode means connected in series with the corresponding functional device between said conductors to provide said energizing path, and said second circuit means comprises a resistance means connected in parallel with said diode means to provide said supervisory path.

10. A supervisory circuit as set forth in claim 9 wherein said energizing means includes control means operable in a first mode to enable unidirectional current flow over said supervisory circuit paths to permit monitoring of the operability of the functional devices, said control means being operable in a second mode to enable unidirectional current flow over said energizing circuit paths to permit energization of said functional devices.

11. A supervisory circuit as set forth in claim 9 wherein said detecting means includes operational amplifier means having first and second inputs connected to said first and second nodes, respectively, said operational amplifier means normally providing an output signal of a predetermined amplitude whenever a potential difference of said preselected level is provided between said first and second nodes, indicating that said first and second conductors are continuous and that all of said functional devices are conductive.

12. A supervisory circuit as set forth in claim 11 wherein said output means comprises first and second switching means and indicator means controlled by said first and second switching means, said first switching means being responsive to an increase in the output signal provided by said operational amplifier means to enable said indicating means and said switching means being responsive to a decrease in the output signal provided by said operational amplifier means to effect enabling of said indicating means.

13. A supervisory circuit as set forth in claim 10 wherein said first switching means includes a first transistor means biased to be normally non-conducting, and means responsive to an increase in the output signal provided by said operational amplifier means for enabling said first transistor means to be rendered conductive to enable said indicating means, said second switching means including second transistor means biased to be normally conducting, and means responsive to a decrease in the output signal provided by said operational amplifier means for enabling said second transisitor means to be rendered non-conducting, said first transistor means being rendered conducting whenever said second transistor means is non-conducting to thereby enable said indicating means.

* * * * *